US007493710B2

(12) United States Patent
Frey et al.

(10) Patent No.: US 7,493,710 B2
(45) Date of Patent: Feb. 24, 2009

(54) SNOWPLOW WITH PIVOTING SIDEBLADES

(75) Inventors: Oscar Frey, Listowel (CA); Ryan Earl Frey, Listowel (CA)

(73) Assignee: 1708828 Ontario Inc., Listowel, Ontario (CA)

( * ) Notice: Subject to any disclaimer, the term of this patent is extended or adjusted under 35 U.S.C. 154(b) by 75 days.

(21) Appl. No.: 11/686,645

(22) Filed: Mar. 15, 2007

(65) Prior Publication Data

US 2008/0222926 A1 Sep. 18, 2008

(51) Int. Cl.
*E01H 5/04* (2006.01)

(52) U.S. Cl. ..... 37/216; 37/274; 37/281

(58) Field of Classification Search ..... 37/216, 37/241, 264, 266, 273, 274, 279, 281; 172/815
See application file for complete search history.

(56) References Cited

U.S. PATENT DOCUMENTS 5,758,728 A * 6/1998 Ragule ..... 172/815
5,819,444 A * 10/1998 Desmarais ..... 37/281
6,273,198 B1 * 8/2001 Bauer et al. ..... 172/825
7,100,311 B2 * 9/2006 Verseef ..... 37/234

* cited by examiner

*Primary Examiner*—Gary S Hartmann
(74) *Attorney, Agent, or Firm*—Anthony Asquith Corp.

(57) ABSTRACT

The left and right sideblades are hinged to the mainblade about vertical axes, and can pivot each through 180°. The sideblades are rotated by means of left and right hydraulic rotary actuators. The actuator includes a piston formed with helical splines, which drive a rotor sleeve of the actuator to rotate in a single-plane-circle when the piston is driven axially. The journal bearings in the rotary actuator are supplemented by bearings provided in a coaxial lower hinge, which are of much greater journal capacity than the bearings in the rotary actuators. The lower hinge protects the hydraulic rotary actuator from shocks due to the sideblade impacting against a kerb.

7 Claims, 5 Drawing Sheets

29
72
29B
50
52
58
56
54
59
57
29U
29A
45M

SNOWPLOW WITH PIVOTING SIDEBLADES

This invention relates to the provision of hinged sideblades on snowplows, and to the manner in which sideblades are mounted and actuated for pivoting. Often, it is desired that the sideblades can be rotated through 180 degrees, from full forward to full back, and to any angle therebetween. It is also desired that the left and right sideblades can be rotated independently.

Traditionally, such sideblades have been actuated by conventional linear hydraulic rams and associated levers. However, it is difficult to provide a full 180 degrees of arcuate travel by means of linear rams and levers. Some designers have resorted to double ram/lever arrangements, which are expensive and intricate.

Instead of an arrangement of rams and levers, in the designs as depicted herein a rotary actuator is employed for the purpose of rotating the sideblade. A rotary actuator is a standard proprietary item; in the typical hydraulic version, a rotary actuator contains a hydraulic ram, which drives a piston having helical splines. A complementarily-grooved rotor sleeve fits within the piston, whereby the sleeve rotates when the ram is pressurised. The machine component to be rotated is bolted to the rotor sleeve.

Rotary actuators are sold for use in hydraulic equipment. Typically, the rotary actuator includes a housing or casing that is bolted to the fixed frame of the equipment. The component to be rotated rotates with the rotor sleeve about an axis defined by bearings housed inside the actuator unit, the axis of the bearings being (usually) the same as the operational axis of the ram.

A rotary actuator—as that expression is used herein—should be contrasted with a motor. A motor is capable of spinning continuously at so many revolutions per minute, whereas a rotary actuator is capable only of a limited arcuate movement about its rotary axis. The rotor sleeve of a rotary actuator (to which the component to be rotated is attached) cannot move beyond that arc, i.e cannot spin continuously.

A conventional rotary actuator has its own bearings, inside the housing of the actuator. In the conventional applications of the rotary actuator, it has been traditional to use the bearings already provided in the rotary actuator as the only bearings needed to support the rotary component. This is fine, if the loading on the rotating component is more or less a pure torque, without heavy journal loading. Thus, the use of rotary actuators, though not confined to pure-torque, or almost pure-torque, applications (in which the journal or radial loading is small), have been used therein. On the other hand, the bearings inside the actuator housing are (or could be) robust enough, and design applications in which the bearings are called upon to support substantial journal loading are not unknown.

Typically, in a snowplow sideblade application, the sideblade rotates about a vertical axis. The expression "vertical axis" should be understood as including cases where the rotary axis is actually at a measurable angle relative to the vertical, but where the rotary axis has a predominating vertical component.

The sideblade, like any snowplow blade, is inevitably subjected to occasional very large abusive impacts. These can occur when the sideblade strikes a kerb, or a manhole-cover, etc. These impacts do indeed transmit heavy journal loading into the (vertical) sideblade bearings.

It is recognised that such violent abusive loads occur often enough that, if a hydraulic rotary actuator were subjected to the brunt of the violence, the length of the service life of the rotary actuator might not be satisfactory. It was an aim, in the designs as depicted herein, to isolate and protect the rotary actuator from the violent impacts that are inflicted upon the sideblade.

By way of further explanation, examples will now be described with reference to the accompanying drawings, in which.

The apparatuses shown in the accompanying drawings and described herein are examples. The scope of the patent protection sought is defined by the accompanying claims, and not necessarily by specific features of the examples.

Figure 1:
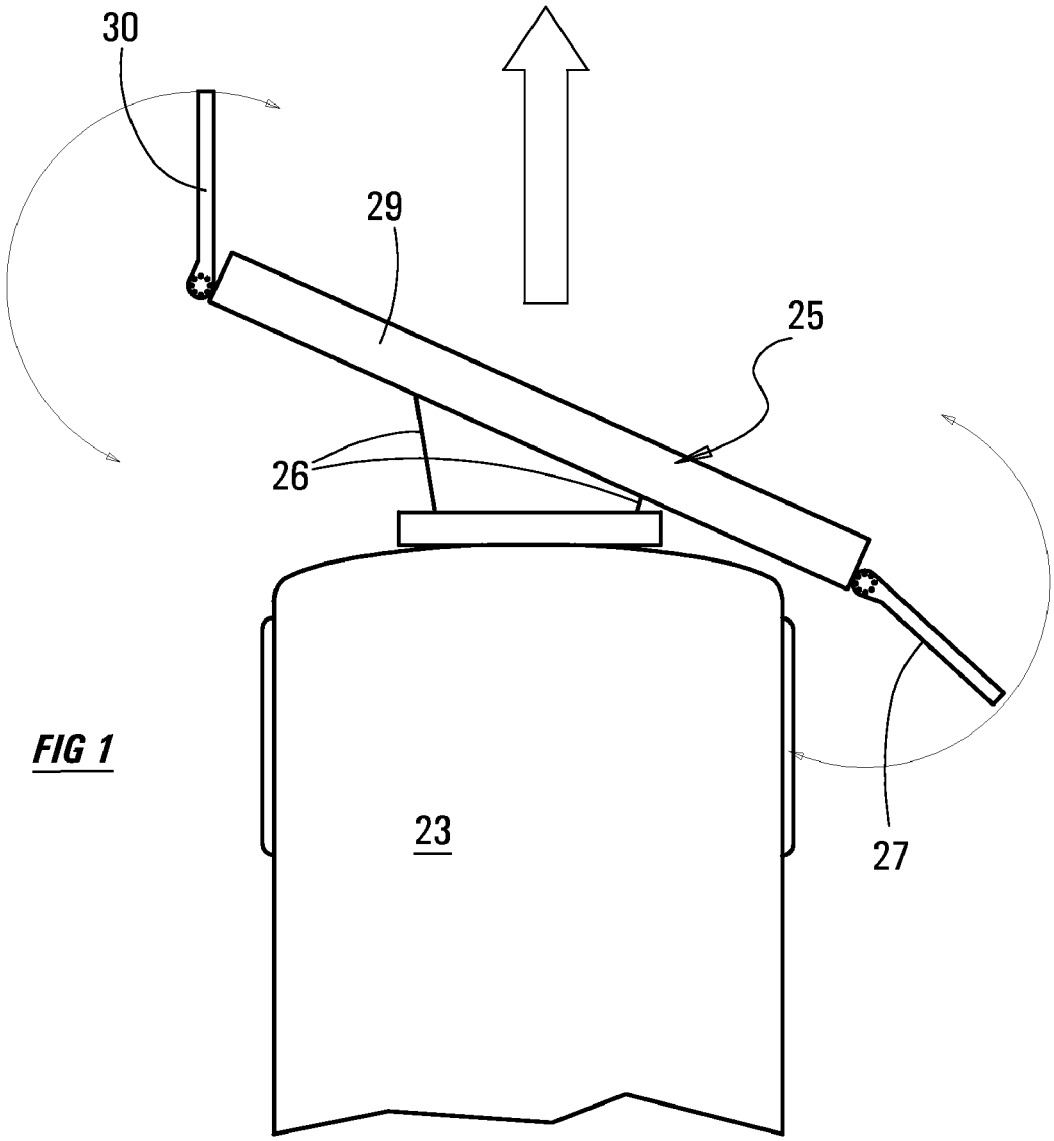
FIG. 1 is a (diagrammatic) plan view of a truck pushing a snowplow assembly, with sideblades.

As shown in FIG. 1, a truck 23 is pushing a snowplow unit 25 forwards, in the direction of the arrow. A mainblade 29 is angled so that snow is being deflected off to the right side. As usual, the truck driver actuates hydraulic rams 26 to set the deflection angle of the main blade.

Sometimes, it is desired to increase the effective width of a snowplow, especially rightwards, and a right sideblade 27 is shown extending from the mainblade 29, in order to increase the width or reach of the snowplow, in that direction.

Sometimes, also, it can be a problem that some snow might spill off to the left of the mainblade 29. To inhibit this, in FIG. 1 a left sideblade 30 has been extended forwards. Both sideblades 27, 30 are pivoted or hinged at the respective left and right ends of the mainblade 29. The hinging structure permits the sideblades to have a full one-eighty degrees range of arcuate movement relative to the mainblade, from perpendicular leading the mainblade to perpendicular trailing the mainblade.

Other orientations of the left and right sideblades can be required in other circumstances, and the sideblades 27, 30 are rotatable each through 180°, as indicated by the arcuate arrows, relative to the mainblade 29. The orientations of the left and right sideblades are controllable by the driver, using appropriate hydraulic flow control valves (not shown). The valves control flow to the ports of right and left rotary actuators, which are described below.

Figure 2:
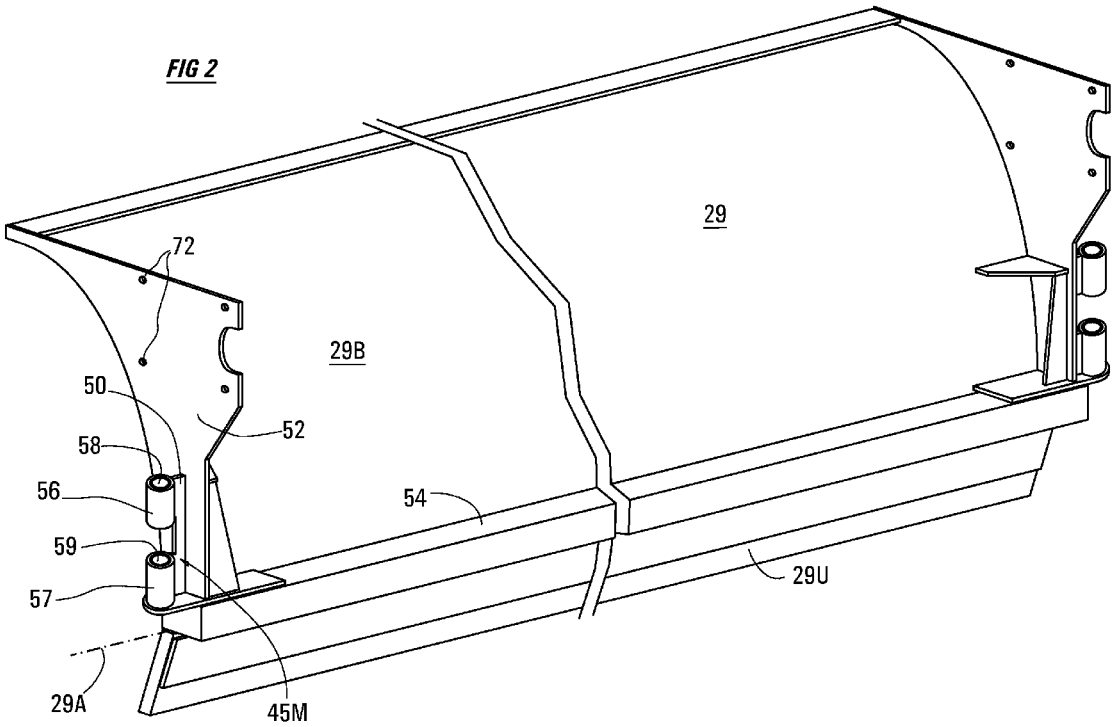
FIG. 2 is a pictorial view of the rear of the mainblade of a snowplow, illustrating how sideblades are attached thereto.

As shown in FIG. 2, the mainblade 29, as a unit, includes an underblade 29U. An underblade is conventionally included in a snowplow, in case it should strike a road-object such as a manhole cover, a kerb, an embedded lane-indicator, etc. The underblade 29U is hinged, being mounted for pivoting movement about an axis 29A running left-right (i.e widthwise) across the mainblade 29, whereby the top edge of the underblade 29U is hinged to the bottom edge of the curved blade 29B. The underblade 29U is held in its normal working position relative to the blade 29B by means of heavy springs. When an impact happens, the springs allow the underblade 29U to pivot rearwards, thus protecting the mainblade 29 from the full violence of the impact. As mentioned, the provision of a hinged, sprung, underblade is conventional. The sideblades 27, 30 also have hinged, sprung, underblades 27U, 30U (described later), corresponding to the main underblade 29U.

The right sideblade 27 can be considered to be at least partially protected by its hinged, sprung, underblade, against violent impacts due to road-objects striking that underblade. However, the left sideblade 30 is not protected, or not so well-protected, by its hinged, sprung, underblade 30U, because an impact would strike end-on against the leading edge of that left underblade. It is impacts like that that can cause the bearings in a rotary actuator to deteriorate, if those impacts were felt by the actuator.

The violent impact is felt mainly by the bottom regions of the sideblade hinge structure. In the designs depicted herein, the vertical axis 32 about which the sideblade pivots is defined by two spaced bearings, i.e an upper hinge bearing 43 and a lower hinge bearing 45. The lower hinge bearing 45 is the subject of FIG. 4. The upper hinge bearing 43 is the bearing inside the rotary actuator 47, the subject of FIG. 5.

The lower hinge bearing 45 includes a main hinge leaf 45M, attached to the main blade 29B, and a side hinge leaf 45S, attached to the left side blade 30B. A hinge-pin 49 connects the two hinge leaves.

The main leaf 45M of the lower hinge 45 includes a main bracket 50. The main bracket 50 is welded to an endplate 52 of the mainblade 29. The bracket 50 is also welded to a bolster 54, which runs the width of the mainblade (and on which are mounted the bearings that define the pivot axis 29A). The main bracket 50 carries upper and lower cylindrical tubes 56, 57, into which have been pressed cylindrical bearing-rings 58, 59. The bearing-rings are a running fit over the hinge-pin 49.

The side leaf 45S of the lower hinge includes a side bracket 60. The side bracket 60 is welded to the blade 30B of the left sideblade 30. The side bracket 60 is also welded to a reinforcing strut 63 of the blade 30B. The side bracket 60 carries upper and lower cylindrical tubes 64, 65, into which have been pressed cylindrical bearing-rings 67, 68. Again, these bearing-rings are a running fit over the hinge-pin 49. The bearing rings 58, 59, 67, 68 are of suitable bearing material, preferably a metal such as a bronze-based bearing metal, although a plastic material such as (filled) PTFE may be considered.

Collars 70 are clamped to the hinge-pin 49, and serve to locate the hinge-pin 49 in a vertical sense in the lower hinge 45.

The function of the main bracket 50 is to ensure that the bearing-rings 58, 59 are functionally unitary with the main blade 29B. The designer should see to it that the cylindrical tubes 56, 57 are supported solidly and rigidly with respect to the blade 29B, and should provide such brackets, struts, reinforcements, etc, as are required to ensure that this is so. The extent to which the tubes and the blade should be solid and rigid with respect to each other is such that the tubes and blade remain mutually solid and rigid, even when subjected to the largest abusive forces that the snowplow as a whole is designed to encounter. The same applies to the solidity and rigidity with which the cylindrical tubes 64, 65 are supported with respect to the side blade 29B.

The main bracket 50 carries two spaced tubes 56, 57, and the side bracket 60 carries two spaced tubes 64, 65. These four tubes are arranged geometrically so as to intercalate, one above another, as shown. This arrangement gives the best support for the pin 49, and for the lower hinge 45 as a whole. The bending stresses on the pin would be higher if only one tube per leaf were provided, or if one leaf had two tubes and the other leaf had only one. The higher the bending stresses on the hinge-pin, the thicker the hinge-pin would have to be, and the more robust the supporting tubes and brackets would have to be. More than two cylindrical tubes per leaf of the hinge would be incrementally better still, from the stress standpoint, but the increment would be small.

The upper hinge bearing 43 comprises the bearings inside the rotary actuator 47. The presence of the lower hinge 45 is a preferred feature of the designs as depicted herein, in that the presence of the highly-robust lower hinge 45 means that the bearings inside the rotary actuator 47 are protected from the violent impacts and abusive loads that the snowplow will inevitably encounter.

It is also preferred that the rotary actuator 47 be provided as the upper hinge, not the lower hinge. If the rotary actuator were to form the lower hinge, the bearings in the rotary actuator would not be isolated and protected nearly so effectively from the violent impacts against the bottom regions of the sideblade.

The housing of the rotary actuator is bolted to the endplate 52 of the mainblade 29, using the prepared bolt-holes 72 as shown in FIG. 2. The designer should arrange for appropriate struts, gussets, and other reinforcing provisions, as required. In FIG. 2, it can be seen that the major stiffening and reinforcing structures are provided in respect of the lower hinge 45, rather than in respect of the rotary actuator/upper hinge 43; again, this is in keeping with the fact that it is the lower hinge 45 that suffers the brunt of the violent impacts.

Figure 3:
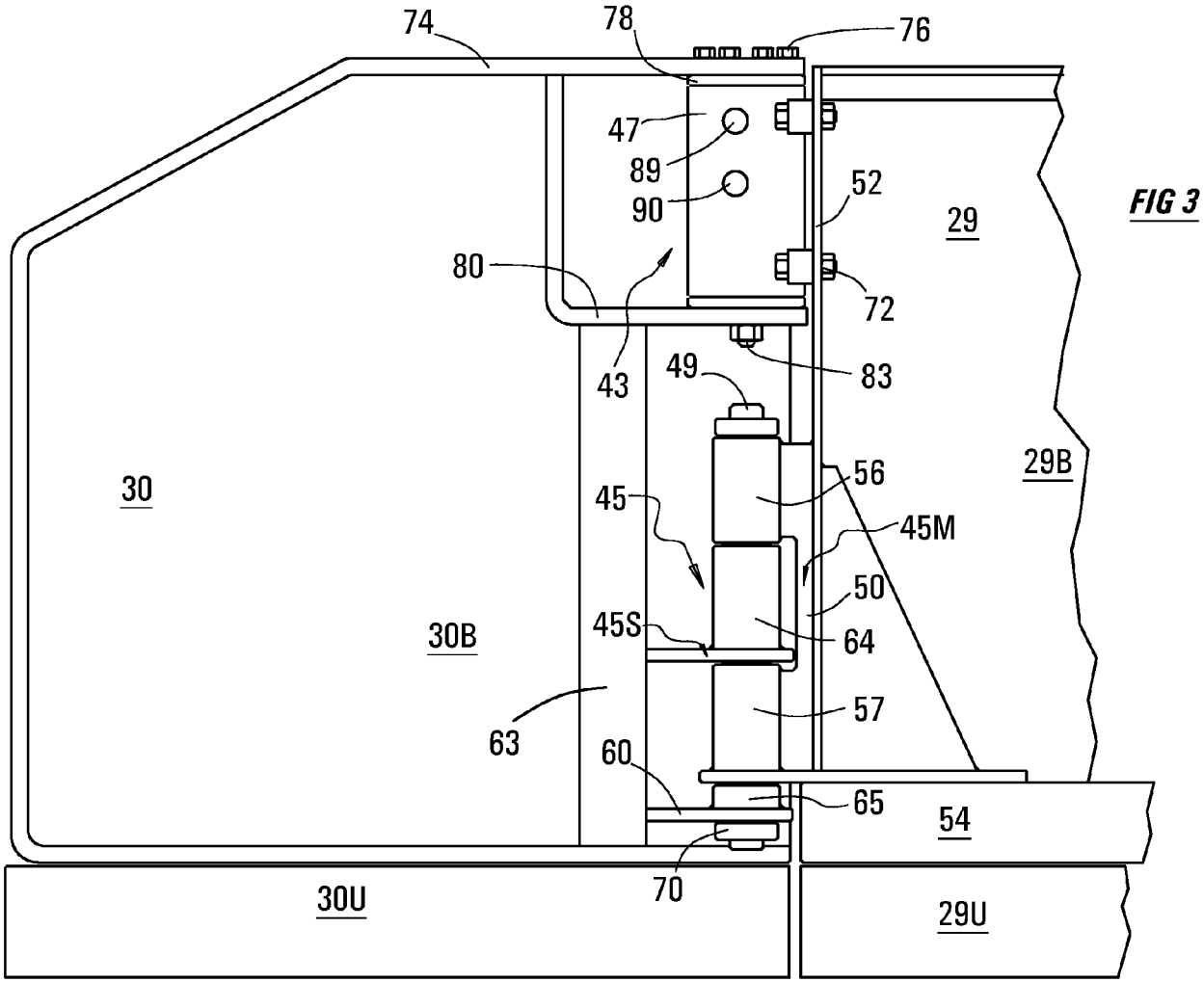
FIG. 3 is a view of the hinge area between the mainblade of FIG. 2 and the sideblade, when the sideblade is in line with the mainblade, viewed from the rear of the snowplow.

In FIG. 3, a top strip 74 of the sideblade 27 is bolted, at 76, to the rotor sleeve 78 of the rotary actuator 47. A bottom strip 80 is part of the structure of the sideblade 27, and is clamped also to the rotor sleeve 78. A longbolt 83 passes lengthwise through the hollow interior of the rotor sleeve 78, clamping the bottom strip 80 also to the rotor sleeve 78.

Figure 5:
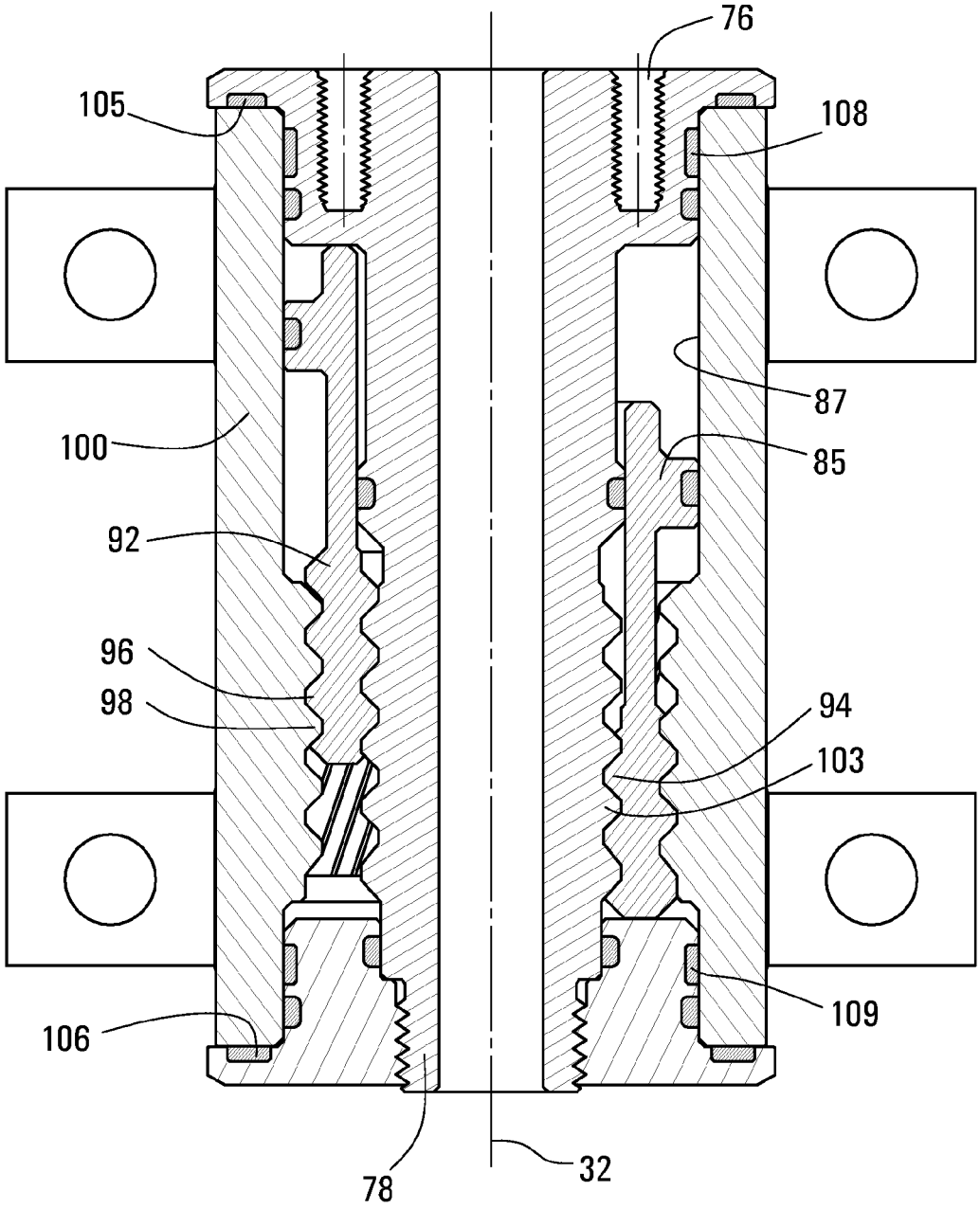
FIG. 5 is a cross-section of a rotary actuator.

The structure and operation of the rotary actuator 47 will now be described with reference to FIG. 5. A rotary actuator is a proprietary item, and designs other than the example now described may be employed. It is preferred that the actuator be of a design in which the rotor sleeve 78, to which the item to be rotated is bolted, should swivel in a single-plane circle, the plane of the circle being perpendicular to the axis of rotation of the actuator. This preference is followed in the design as shown in FIG. 5. It would not be preferred if the actuator were of a design in which the rotor sleeve follows e.g a helical path.

The actuator includes a hydraulic piston 85, which reciprocates in a cylinder 87. On the left of FIG. 5, the piston is shown in its uppermost position, and is shown on the right in its lowermost position. Ports 89, 90 (FIG. 3) transfer hydraulic fluid into and out of the cylinder 87, above and below the piston 85. Attached to the piston 85 is a skirt 92. The skirt 92 is formed with internal 94 and external 96 helical splines. The helical splines may be regarded equally as a multi-start screw thread, having a steep helical lead angle. When the piston 85 moves downwards, the engagement of the male splines 96 with the corresponding female splines 98 in the actuator housing 100 causes the piston to rotate. Thus, the piston 85, with its skirt 92, undergoes a helical movement, i.e undergoes rotation with a simultaneous axial movement.

The internal female splines 94 on the skirt 92 engage the male splines 103 on the rotor sleeve 78. The internal and external splines 94, 96 are of opposite hand, whereby the sleeve 78 rotates through an overall angle of arc that is determined by the sum of the respective helical lead angles of the two splines. The rotor sleeve 78 cannot move axially with respect to the housing 100, being confined between thrust bearings 105, 106. The rotor sleeve 78 is guided for rotation in the housing 100 in journal bearings 108, 109. Thus, the structure of the hydraulic rotary actuator 47 is such that the sleeve 78 rotates in a single-plane circle when relatively pressurised hydraulic fluid is applied to one of the ports 89, 90.

Figure 4:
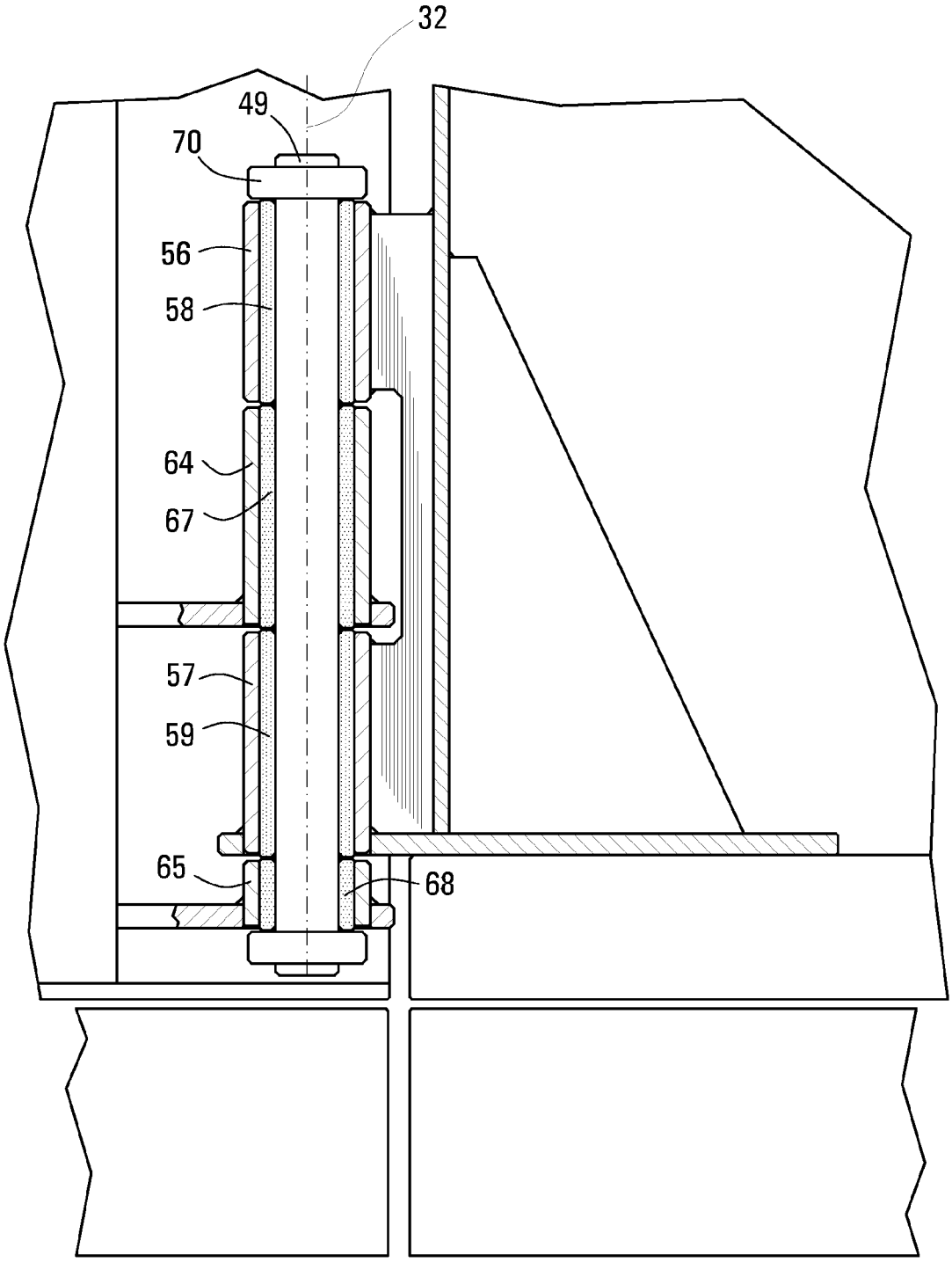
FIG. 4 is a sectional view of part of the hinge area shown in FIG. 3.

As shown in FIG. 4, the bearing rings 58, 59, 67, 68 are arranged to perform thrust duties, in addition to their journal duties. However, this requires careful vertical alignment of the rings in relation to the rotary actuator—which also includes thrust bearings—and the designer might prefer to arrange the bearing rings so that they cannot touch each other in the thrust sense, whereby all the thrust loading falls on the bearings 105, 106 in the hydraulic rotary actuator 47. (The abusive impact shocks that a snowplow blade encounters generally have only a small thrust component.)

The extent of the arcuate travel of the rotor sleeve 78 is determined by the geometry of the actuator. In the particular example, the axial length of travel of the piston 85, and the lead angles of the two helical splines, is such that the rotor sleeve is designed to undergo a maximum arcuate travel of 180°, as the piston is driven from top to bottom of its available travel within the cylinder 87.

It will be understood that the bearings 105, 106, 108, 109 in the rotary actuator are not intended or designed to cope with violent abusive loadings. The bearings can be plain, as shown, and of nylon, bronze, etc, as required. The bearings 105, 106, 108, 109 are designed to cope with the axial and radial loads that are applied to the bearings as a result of the torque that is generated in the sleeve due to the applied hydraulic pressure. Of course, the prudent designer of the actuator provides a margin of tolerance, by which the bearing capacity is sufficient to provide a long service life, but it is recognised that the kind and size of the bearings normally encountered in a hydraulic rotary actuator, by themselves, fall well short of the robustness needed to support a hinging sideblade of a snowplow.

The radially-projected bearing area of the journal bearings 108, 109 in the rotary actuator (i.e in the upper hinge 43) may be compared with the radially-projected bearing area of the bearing rings 67, 68 in the lower hinge 45. It is apparent, from the difference in size, that the load capacity of the lower hinge is an order of magnitude greater than the load capacity of the bearings 108, 109 in the actuator. It might be possible for a rotary actuator to be designed in which the load capacity of the journal bearings was the equal of the load capacity of the lower hinge 45; however, it can easily be seen how such an increased load capacity would entail some very radical changes to the structure (and to the cost) of the rotary actuator. Providing a lower hinge 45 of hugely increased load capacity, as compared with the actuator, means that the standard conventional rotary actuators can be used in the snowplow blade application as described herein, without modification and without damage.

Because of the new arrangement as described herein, only the lower hinge 45 suffers the effects of the impacts on the snowplow sideblade. The relatively puny bearings 108, 109 in the rotary actuator 47 are substantially protected from impacts by the provision of the relatively huge bearings in the lower hinge 45. It is a simple matter to design the bearings of the lower hinge to be robust enough to take the heavy impacts. Thus it is recognised that, in the snowplow application, it would be much less preferred to provide just the rotary actuator as the sole hinge bearing, with no supplementary hinge bearing.

It will be recognised from the drawings that providing the hinge bearings with the high degree of robustness as described is achieved without resorting to hydraulic rams and linkages. The rotary actuator has a neat, compact form, and is much less likely to be damaged, in the abusive snowplow environment, than an equivalent rams-and-linkage type of rotation-producing mechanism. Also, the rotary actuator being fixed to the mainblade, the hydraulic hose and lines to the rotary actuator do not move, relative to the mainblade, during operation—which means that flexible hoses—which are expensive and vulnerable to damage—can be reduced or even eliminated.

The proprietary rotary actuator, though an expensive item in itself, actually can work out cheaper, in overall money terms, than the equivalent linear ram(s) and associated linkage. Also, the rotary actuator is small and neat—being hugely different, in that respect, from the ram-and-linkage equivalent.

As shown, preferably the snowplow includes both left and right sideblades, of which both can pivot through 180°. However, the rotary actuator can be used in the manner described herein in a snowplow that has only one sideblade.

REFERENCE NUMERALS

23 truck
25 snowplow unit
27 right sideblade (unit)
27U underblade for . . .
29 mainblade (unit)
29U underblade of 29
29B blade of 29
29A pivoting axis of 29U (horizontal)
30 left sideblade
32 hinge axis of 30
43 upper hinge bearing
45 lower hinge bearing
45M main hinge leaf
45S side hinge leaf
47 rotary actuator
49 hinge pin
50 main bracket of main leaf 45M
52 endplate of mainblade
54 bolster at foot of mainblade
56 upper cylindrical tube of main leaf
57 lower cylindrical tube of main leaf
58 upper bearing ring in 56
59 lower bearing ring in 57
60 side bracket of side leaf 45S
63 reinforcing strut in sideblade 27
64 upper cylindrical tube of side leaf
65 lower cylindrical tube of side leaf
67 upper bearing ring in 64
68 lower bearing ring in 65
70 collars
72 bolt-holes in endplate 52 for 47
74 top strip of sideblade
76 ring of bolts to . . .
78 rotor sleeve
80 bottom strip
83 longbolt
85 piston
87 cylinder
89 upper hydr port
90 lower hydr port
92 skirt
94 internal splines on skirt
96 external splines on skirt
98 female splines in . . .
100 actuator housing
103 male splines on rotor sleeve 78
105 upper thrust bearing
106 lower thrust bearing
108 upper journal bearing
109 lower journal bearing

The invention claimed is:

1. Snow-plow assembly, wherein:

the assembly includes a mainblade and a sideblade;

the assembly includes a pivot-hinge, located at or near one end of the mainblade, whereby the sideblade is constrained for pivoting movement relative to the mainblade; and the pivot-hinge includes a hydraulic rotary actuator.

2. As in claim 1, wherein:

the rotary actuator comprises a housing and a rotor;

one of the housing or the rotor is fastened to the mainblade, and the other to the sideblade;

inside the housing of the actuator, the actuator includes a hydraulic cylinder and a complementary piston;

the rotor is mounted in bearings in the housing, which guide the rotor for rotation; and the rotary actuator includes an operable driver, located inside the housing, which is effective, when operated, to drive the rotor to rotate relative to the housing.

3. Snow-plow assembly, wherein:

the assembly includes a mainblade and a sideblade;

the assembly includes a pivot-hinge, located at or near one end of the mainblade, whereby the sideblade is constrained for pivoting movement relative to the mainblade;

the pivot-hinge includes a hydraulic rotary actuator;

the rotary actuator comprises a housing and a rotor;

one of the housing or the rotor is fastened to the mainblade, and the other to the sideblade;

inside the housing of the actuator, the actuator includes a hydraulic cylinder and a complementary piston;

the rotor is mounted in bearings in the housing, which guide the rotor for rotation;

the rotary actuator includes an operable driver, located inside the housing, which is effective, when operated, to drive the rotor to rotate relative to the housing;

the operable driver includes a hydraulic piston and cylinder;

the cylinder is included in the housing, and the housing is formed with an external hydraulic port that connects with the cylinder;

the piston includes a skirt;

the skirt is formed with an external spline, which engages a corresponding spline in the housing;

the skirt is formed with an internal spline, which engages a corresponding spline in the rotor; and at least one of the splines is of helical form, the splines being so arranged that, when the piston moves along the cylinder, the rotor simultaneously rotates.

4. As in claim 3, wherein the actuator is so arranged that the rotor, when rotating, follows a path that lies in a single-plane circle, perpendicular to the cylinder axis, and the path has substantially no axial component.

5. Snow-plow assembly, wherein:

the assembly includes a mainblade and a sideblade;

the assembly includes a pivot-hinge, located at or near one end of the mainblade, whereby the sideblade is constrained for pivoting movement relative to the mainblade;

the pivot-hinge includes a hydraulic rotary actuator;

the pivot hinge includes an upper hinge and a coaxial lower hinge;

the upper hinge includes the rotary actuator;

the lower hinge comprises a main hinge leaf and a side hinge leaf;

the main hinge leaf includes a main tube;

the side hinge leaf defines a side tube;

the lower hinge includes a hinge-pin, and the main tube and the side tube are both structured to receive the hinge-pin;

the hinge-pin is rotatable relative to at least one of the main hinge leaf or the side hinge leaf;

the main hinge leaf is so fastened to the mainblade that the main hinge leaf is operationally unitary with the mainblade;

the side hinge leaf is so fastened to the sideblade that the side hinge leaf is operationally unitary with the sideblade;

the side hinge leaf and the side tube are of such strength and rigidity as to receive the shock of an impact of a road object against an impact zone of the sideblade, and to transmit that shock substantially undiminished to the hinge-pin; and the hinge-pin, the main tube, and the main hinge leaf, are of such strength and rigidity as to receive the said shock from the hinge-pin, and to transmit that shock substantially undiminished to the mainblade.

6. As in claim 5, wherein:

the side tube contains a side bearing ring, and the main tube contains a main bearing ring;

the hinge-pin is a guided fit within both the side bearing ring and the main bearing ring; and in operation of the snowplow, the axis of the hinge-pin, being the axis also of the rotary actuator, is substantially vertical.

7. As in claim 6, including:

at least one of the main bearing ring and the side bearing ring is in two portions, arranged in a spaced-apart, one-above-the-other configuration; and the other of the bearing rings lies intercalated with respect to the said two portions.

* * * * *